US006106766A

United States Patent [19]

Kawai et al.

[11] Patent Number: 6,106,766

[45] Date of Patent: Aug. 22, 2000

[54] MATERIAL FOR GAS TURBINE DISK

[75] Inventors: Hisataka Kawai; Yoshikuni Kadoya; Koji Takahashi; Ryotaro Magoshi; Yasuhiko Yasumoto; Tomohiro Tsuchiyama, all of Takasago, Japan

[73] Assignees: Kabushiki Kaisha Kobe Seiko Sho, Kobe; Mitsubishi Heavy Industries, Ltd., Tokyo-to, both of Japan

[21] Appl. No.: 09/236,636

[22] Filed: Jan. 26, 1999

[30] Foreign Application Priority Data

Jan. 27, 1998 [JP] Japan ..... 10-014442

[51] Int. Cl.[7] ..... C22C 38/44; C22C 38/46

[52] U.S. Cl. ..... 420/69; 420/38; 148/325

[58] Field of Search ..... 420/69, 38; 148/325

[56] References Cited

FOREIGN PATENT DOCUMENTS

| | | |
|---|---|---|
| 0 867 522 | 8/1998 | European Pat. Off. . |
| 0 867 523 | 9/1998 | European Pat. Off. . |
| 4-371551 | 12/1992 | Japan . |
| 5-306429 | 11/1993 | Japan . |
| 6-33196 | 2/1994 | Japan . |
| 8-333657 | 12/1996 | Japan . |

*Primary Examiner*—Deborah Yee

*Attorney, Agent, or Firm*—Oblon, Spivak, McClelland, Maier & Neustadt, P.C.

[57] ABSTRACT

A material for a gas turbine disk comprises 0.05 to 0.15 wt % of carbon, 0.10 wt % or less of silicon, 0.40 wt % or less of manganese, 9.0 to 12.0 wt % of chromium, 1.0 to 3.5 wt % of nickel, 0.50 to 0.90 wt % of molybdenum, 1.0 to 2.0 wt % of tungsten, 0.10 to 0.30 wt % of vanadium, 0.01 to 0.10 wt % of niobium, 0.01 to 0.05 wt % of nitrogen, and a remainder comprising iron and unavoidable impurities, wherein the contents of nickel, molybdenum and tungsten satisfy a relationship $-1.5$ wt $\% \leqq Mo+W/2-Ni \leqq 0.7$ wt %. Accordingly, unlike conventional gas turbine disk materials such as a heat resisting steel of 12Cr-type which can be used in an operation at about 400° C., but has reduced toughness and high-temperature creep characteristics in an operation at about 500° C., this material is allowed to have a satisfactory toughness and excellent high-temperature creep characteristics and can be suitably used at high temperatures.

14 Claims, No Drawings

MATERIAL FOR GAS TURBINE DISK

BACKGROUND OF THE INVENTION

The present invention relates to a gas turbine disk material suitable for a gas turbine used as a motor in power plants.

In general, steam turbines are widely used as a motor for the main power generation in power plants in view of thermal economy. Recently, gas turbines have come to be widely used in view of environmental problems and good operability. Such gas turbines are activated at or around normal temperature and operated under high load. Accordingly, a material for gas turbine disks is required to have excellent strength and toughness in a temperature range between normal temperature and high temperature and excellent high-temperature creep characteristics which ensure a small reduction in strength in operation at high temperature.

As a material for such gas turbine material are used 12Cr-type heat resisting steels containing 8 to 12 percent by weight (hereinafter, merely "wt %") of chromium such as M152 (the composition thereof corresponds to a sample B1 in TABLE-1 later). The gas turbine disk materials of this type contain nickel to ensure toughness and contain molybdenum and vanadium in addition to chromium for a solid-solution hardening of a base construction and for a better dispersion by carbides of the respective elements, thereby improving high-temperature creep characteristics to be used for a gas turbine operated at about 400° C.

In recent years, power is generated in power plants at higher temperature and under higher pressure in order to improve a thermal efficiency. Thus, there is a demand for a gas turbine disk material which has excellent creep characteristics even at a high temperature exceeding 500° C.

However, a textural change is likely to occur at high temperature in existing heat resisting steels having a high chromium content such as M152, thereby causing a reduction in creep strength. Thus, such conventional gas turbine disk materials reduce the reliability of power plants in the case of operations in a thermal environment from normal temperature to 500° C. or above.

SUMMARY OF THE INVENTION

In view of the above problem, an object of the present invention is to provide a gas turbine disk material suitable for the use in a temperature range from normal temperature to 500° C. or above.

In order to accomplish the above object, the inventors of the present invention devotedly studied factors which influence the high-temperature characteristics and toughness of a heat resisting steel of 12Cr-type. As a result of their study, it was newly found out that a relationship of the contents of nickel, molybdenum and tungsten in the heat resisting steel having a specific composition largely influences the above characteristics. This finding resulted in the present invention.

Specifically, a gas turbine disk material according to the invention comprises 0.05 to 0.15 wt % of carbon, 0.10 wt % or less of silicon, 0.40 wt % or less of manganese, 9.0 to 12.0 wt % of chromium, 1.0 to 3.5 wt % of nickel, 0.50 to 0.90 wt % of molybdenum, 1.0 to 2.0 wt % of tungsten, 0.10 to 0.30 wt % of vanadium, 0.01 to 0.10 wt % of niobium, 0.01 to 0.05 wt % of nitrogen, and a remainder comprising iron and unavoidable impurities, wherein the contents of nickel, molybdenum and tungsten satisfy a relationship $-1.5$ wt $\% \leqq Mo+W/2-Ni \leqq 0.7$ wt %.

Either one of or both of 0.01 to 4.0 wt % of cobalt and 0.0001 to 0.010 wt % of boron may be further added to the above composition.

DETAILED DESCRIPTION OF THE PREFERRED EMBODIMENTS OF THE INVENTION

A gas turbine disk material according to the invention is produced, for example, by a method described below.

First of all, steel is melted after being adjusted to have a composition defined according to the invention using a deoxidation method such as a vacuum carbon deoxidation method. A steel ingot is produced from the deoxidized molten steel by a suitable casting method. Thereafter, hot forging is applied so as to give a specified shape to this steel ingot. Further, quenching is performed, for example, under such a condition that oil quenching is performed after the steel ingot is heated up to an austenitization temperature, thereby obtaining a substantially uniform martensite texture. Subsequently, tempering such as double tempering is performed.

In the conventional martensite heat resisting steels, there are cases where δ-ferrite which considerably reduces heat processability is produced when, for example, the steels are forged. In order to suppress the production of this δ-ferrite, the chemical composition is set as above. Further, by specifying a quantitative relationship of nickel, molybdenum and tungsten, the steel is allowed to have an excellent toughness at normal temperature, to maintain a high strength up to a temperature above 500° C., and to improve creep characteristics such as a creep rupture strength and a creep rupture time at high temperature.

Next, the reason why the chemical composition was set as above is given.

Carbon is an element which forms a carbide having a high hardness by being bonded to chromium, niobium, vanadium, etc. and gives a large influence on high-temperature strength. However, if the carbon content is below 0.05 wt %, neither sufficient carbides nor uniform martensite texture can be obtained. In other words, the obtained texture is a mixed texture of martensite, δ-ferrite, and the like, resulting in a considerable reduction in high-temperature strength and high temperature fatigue strength. On the other hand, if the carbon content is above 0.15 wt %, not only toughness is reduced, but also the carbide considerably agglomerates and becomes coarse during the use at high temperature. Accordingly, the carbon content is set in a range of from 0.05 wt % to 0.15 wt %.

Silicon is used as a deoxidizing agent. If the silicon content exceeds 0.10 wt %, segregation becomes extreme in a large steel ingot and toughness after the use for many hours. Accordingly, the silicon content is set at 0.10 wt % or less.

Manganese is used as a deoxidizing agent similar to silicon. Its effects are sufficiently attained with a content of 0.40 wt %. Since manganese is an element which promote embrittlement, it is desirable to have a small manganese content. Accordingly, the manganese content is set at 0.40 wt % or less.

Chromium improves oxidation resistance and creep rupture strength. If the chromium content is below 9.0 wt %, no sufficient oxidation resistance and creep rupture strength can be obtained. On the other hand, if the chromium content exceeds 12.0 wt %, although creep rupture strength is not reduced to a large extent, δ-ferrite precipitates, thereby reducing toughness and high-temperature fatigue characteristics. Accordingly, the chromium content is set in a range between 9.0 wt % to 12.0 wt %.

Nickel is an element which improves hardenability and toughness at normal temperature. If the nickel content is below 1.0 wt % in a high strength member such as a gas turbine disk, the above effects are small. If the nickel content exceeds 3.5 wt %, high-temperature strength and creep rupture strength are considerably reduced. Accordingly, the nickel content is set in a range between 1.0 to 3.5 wt %.

Molybdenum improves high-temperature strength and creep rupture strength by the action of solid-solution strengthening and precipitation strengthening. However, if the content thereof is below 0.50 wt %, its effects are small. If the molybdenum content exceeds 0.90 wt %, δ-ferrite is produced, making it likely to deteriorate toughness and creep rupture strength. Accordingly, the molybdenum content is set in a range between 0.50 wt % to 0.90 wt %.

Tungsten is an element which improves high-temperature strength and creep rupture strength. However, if the content thereof is below 1.0 wt %, its effects are not very large. If the content exceeds 2.0 wt %, there is a likelihood of the precipitation of δ-ferrite which degrades high temperature characteristics. Accordingly, the tungsten content is set in a range between 1.0 to 2.0 wt %.

Vanadium is an element which improves high-temperature strength and creep rupture strength by forming carbides in the form of $V_4C_3$. If the content thereof is below 0.10 wt %, its effects are not sufficient. If the content exceeds 0.30 wt %, carbides agglomerate and become coarse during the use for many hours, thereby reducing creep rupture strength. Accordingly, the vanadium content is set in a range between 0.10 to 0.30 wt %.

Niobium is an element which improves high-temperature strength and creep rupture strength by forming carbides (NbC) similar to vanadium. If the content thereof is below 0.01 wt %, its effects are small. If the content exceeds 0.10 wt %, carbide cannot be sufficiently dispersed even at a quenching temperature of 1100° C., and precipitated carbides agglomerate and become coarse during the creep, reducing creep rupture strength. Accordingly, the niobium content is set in a range between 0.01 to 0.10 wt %.

Nitrogen is an element having effects of improving high-temperature strength and creep rupture strength and preventing the production of δ-ferrite. However, if the content thereof is below 0.01 wt %, its effects are not sufficient. If the content exceeds 0.05wt %, toughness is reduced. Accordingly, the nitrogen content is set in a range between 0.01 to 0.05 wt %.

Among the above components, molybdenum and tungsten are both the elements which improve high-temperature creep characteristics. However, an excessive content thereof makes δ-ferrite likely to precipitate and reduces toughness. A reduction in toughness caused by an increase in the content is larger with molybdenum than with tungsten. Thus, high-temperature creep characteristics can be improved by adding tungsten while suppressing the molybdenum content to or below 0.9 wt %.

On the other hand, toughness can be improved by containing particularly nickel. However, an excessive nickel content degrades the effect of improving high-temperature creep characteristics obtained by the addition of molybdenum and tungsten. Accordingly, the contents (wt %) of nickel, molybdenum and tungsten are required to further satisfy a relationship $-1.5$ wt %$\leqq$Mo+W/2−Ni$\leqq$0.7 wt %. Creep rupture strength is not sufficient if Mo+W/2−Ni<−1.5 wt %, whereas no sufficient toughness can be obtained if Mo+W/2−Ni >0.7 wt %.

By setting the contents of nickel, molybdenum and tungsten as above, high-temperature characteristics and toughness at normal temperature are balanced and the production of δ-ferrite, which adversely influences high-temperature characteristics and toughness at normal temperature, can be suppressed.

The remainder of the heat resisting steel containing the above components is made up of iron and unavoidably mixed impurities. These impurities include phosphorus (P), sulfur (S), etc. Since these elements adversely influence impact characteristics by embrittling a material, it is desirable for their contents to be extremely small.

By setting the chemical composition as above and particularly setting the contents of nickel, molybdenum and tungsten to satisfy the relationship $-1.5$ wt %$\leqq$Mo+W/2−Ni$\leqq$0.7 wt %, the production of δ-ferrite is prevented while a sufficient toughness at normal temperature is ensured. Accordingly, such a material is unlikely to be ruptured even if being subjected to creep at a high temperature above 500° C. for many hours, and can be suitably used as a gas turbine disk material.

On the other hand, high-temperature creep characteristics can be further improved if the composition contains either one or both of cobalt (Co) and boron (B) within the aforementioned amount ranges. The reason why the amount ranges of these components are limited as above in this case is described.

Cobalt is an element which increases an amount of carbides dispersed into matrices, displays itself a solid-solution strengthening action, and is accordingly effective in improving high-temperature strength and creep rupture strength. However, if the content thereof is below 0.01 wt %, its effects are small. If the content exceeds 4.0 wt %, toughness and creep rupture strength are reduced. Accordingly, the cobalt content is set in a range between 0.01 and 4.0 wt %.

Boron is an element which improves high-temperature strength and creep rupture strength. However, if the content thereof is below 0.0001 wt %, its effects are small. If the content exceeds 0.01 wt %, heat processability is adversely influenced. Accordingly, the boron content is set in a range between 0.0001 to 0.01 wt %.

By further containing either one or both of cobalt and boron in the above content ranges, the heat resisting steel is allowed to have further improved high-temperature creep characteristics while maintaining a sufficient toughness at normal temperature. Such a heat resisting steel can be suitably used as a gas turbine disk material.

EXAMPLES

Hereinafter, the present invention is described with respect to Examples.

(1) Samples

The chemical compositions of 12 types of heat resisting steels used as samples are shown in TABLE-1. Among these samples, samples No. A1 to A8 are steels having a chemical composition within a range according to the invention, i.e. Examples of the invention, and samples No. B1 to B4 are comparative materials having a chemical composition outside the range according to the invention. Particularly, sample No. B1 is a material corresponding to M152 steel presently used for gas turbines.

After 50 to 90 kg/charge of these samples were melted by the vacuum melting process, respectively, they were cast into steel ingots. Thereafter, these steel ingots were forged at temperatures of 900 to 1200° C., thereby producing a forged material of 110 mm×110 mm×400 mm. The following heat treatment was applied to these forged materials. Specifically, after being austenitized by being heated at 1050° C. for 15 hours, the forged materials were quenched at a cooling rate at the center of a disk having a thickness of 500 mm when oil quenching was applied thereto. Subsequently, double tempering was applied thereto in which the quenched materials were kept at 550 to 650° C. for 23 hours after being kept at 550° C. for 15 hours to be tempered.

TABLE 1

| SAMPLE | | CHEMICAL COMPOSITION (wt %) | | | | | | | | | | | | | |
|---|---|---|---|---|---|---|---|---|---|---|---|---|---|---|---|
| | | C | Si | Mn | Cr | Ni | Mo | W | V | Nb | N | Co | B | Fe | Mo + W/2-Ni |
| EXAMPLE | A1 | 0.12 | 0.05 | 0.05 | 10.41 | 2.97 | 0.70 | 1.81 | 0.20 | 0.056 | 0.025 | — | — | Rem. | −1.36 |
| | A2 | 0.13 | 0.05 | 0.05 | 10.41 | 2.96 | 0.70 | 1.82 | 0.20 | 0.057 | 0.026 | 3.68 | — | Rem. | −1.35 |
| | A3 | 0.13 | 0.05 | 0.05 | 10.43 | 2.95 | 0.69 | 1.80 | 0.20 | 0.055 | 0.025 | — | 0.0040 | Rem. | −1.36 |
| | A4 | 0.13 | 0.05 | 0.05 | 10.55 | 3.00 | 0.70 | 1.B1 | 0.20 | 0.056 | 0.025 | 3.73 | 0.0039 | Rem. | −1.40 |
| | A5 | 0.12 | 0.05 | 0.05 | 10.61 | 1.01 | 0.70 | 1.82 | 0.20 | 0.055 | 0.026 | 3.73 | 0.0042 | Rem. | 0.60 |
| | A6 | 0.12 | 0.05 | 0.05 | 10.70 | 2.03 | 0.71 | 1.82 | 0.20 | 0.056 | 0.025 | 3.73 | 0.0030 | Rem. | −0.41 |
| | A7 | 0.13 | 0.05 | 0.06 | 10.35 | 2.37 | 0.67 | 1.77 | 0.20 | 0.055 | 0.027 | 0.11 | 0.0002 | Rem. | −0.82 |
| | A8 | 0.12 | 0.05 | 0.05 | 10.33 | 2.47 | 0.68 | 1.74 | 0.20 | 0.054 | 0.026 | 2.47 | 0.0042 | Rem. | −0.92 |
| COM | B1 | 0.11 | 0.02 | 0.03 | 11.67 | 2.72 | 1.73 | — | 0.30 | — | 0.028 | — | — | Rem. | (−0.99) |
| | B2 | 0.12 | 0.05 | 0.05 | 10.12 | 0.09 | 0.65 | 1.71 | 0.21 | 0.055 | 0.026 | — | — | Rem. | 1.42 |
| | B3 | 0.12 | 0.06 | 0.05 | 10.20 | 0.78 | 0.67 | 1.80 | 0.22 | 0.055 | 0.026 | — | — | Rem. | 0.79 |
| | B4 | 0.11 | 0.05 | 0.05 | 10.15 | 3.70 | 0.70 | 1.81 | 0.20 | 0.058 | 0.026 | — | — | Rem. | −2.10 |

(2) Characteristic Estimation Test (a) Charpy Impact Test

The toughness of each sample was estimated in terms of absorption energy and fracture appearance transition temperature (FATT). First, 2 mm V-notch Charpy test pieces of JIS4 were gathered from the respective samples, a Charpy impact test was conducted for them at a testing temperature of 20°C., and a room-temperature absorption energy ($_{2v}E_{20}$) was obtained. Further, the FATT of each sample was obtained by conducting the impact tests while changing the testing temperature. These test results are as shown in TABLE-2. In TABLE-2, 0.2% yield points and tensile strengths obtained by a tensile test at 20° C. are also noted.

(b) High-temperature Creep Test

The creep strengths of the respective samples were estimated in terms of creep rupture time. First, sample pieces of a diameter of 6 mm were gathered from the respective samples, a creep rupture test was conducted in accordance with JIS Z 2272, using these sample pieces. Creep rupture times at 500° C. and 50 kg/mm$^2$ obtained by this test are shown in TABLE-2.

TABLE 2

| SAMPLE | | 0.2% Yield Point (20° C.) [kg/mm$^2$] | Tensile Strength (20° C.) [kg/mm$^2$] | Absop. Energy (20° C.) [kgfm] | FATT [° C.] | 500° C.-50 kg/mm$^2$ Creep Rupture Time [Hour] |
|---|---|---|---|---|---|---|
| EXAMPLE | A1 | 102.3 | 118.7 | 22.5 | −60 | 1520 |
| | A2 | 103.1 | 121.9 | 23.9 | −57 | 2430 |
| | A3 | 103.9 | 121.4 | 26.7 | −70 | 2715 |
| | A4 | 104.9 | 125.2 | 21.0 | −70 | 995 |
| | A5 | 105.0 | 125.3 | 22.0 | −20 | 1450 |
| | A6 | 105.6 | 125.7 | 25.8 | −35 | 808 |

TABLE 2-continued

| SAMPLE | | 0.2% Yield Point (20° C.) [kg/mm$^2$] | Tensile Strength (20° C.) [kg/mm$^2$] | Absop. Energy (20° C.) [kgfm] | FATT [° C.] | 500° C.-50 kg/mm$^2$ Creep Rupture Time [Hour] |
|---|---|---|---|---|---|---|
| | A7 | 108.1 | 121.7 | 20.7 | −27 | 2058 |
| | A8 | 107.6 | 123.7 | 16.5 | −30 | 3361 |
| COMP | B1 | 101.9 | 114.3 | 18.0 | −35 | 398 |
| EXAM | B2 | 97.1 | 115.0 | 1.6 | 110 | 1525 |

TABLE 2-continued

| SAMPLE | | 0.2% Yield Point (20° C.) [kg/mm$^2$] | Tensile Strength (20° C.) [kg/mm$^2$] | Absop. Energy (20° C.) [kgfm] | FATT [° C.] | 500° C.-50 kg/mm$^2$ Creep Rupture Time [Hour] |
|---|---|---|---|---|---|---|
| | B3 | 99.7 | 116.8 | 4.2 | 45 | 957 |
| | B4 | 101.2 | 121.0 | 26.7 | −79 | 568 |

(3) Characteristic Estimation Result

The sample No. B1 corresponding to M152 steel which is presently used as a disk material has a rupture time of only 398 hours in the creep test although it has an excellent toughness at and near normal temperature as can be seen from the respective columns of the absorption energy and FATT of TABLE-2.

Contrary to this, the sample No. A1 has better absorption energy and FATT than the sample No. B1 and an considerably improved creep rupture time. Main differences in composition between the sample No. A1 and the sample No. B1 consist in the addition of niobium, reduction of the content of molybdenum and addition of tungsten. These differences bring about a considerable improvement in high-temperature creep characteristics.

On the other hand, the compositions of the comparative materials Nos. B2 to B4 differ from that of the sample No. A1 mainly in the content of nickel. The respective characteristic estimation results of the samples Nos. B2 to B4 and A1 show that normal-temperature toughness (absorption energy, FATT) is remarkably improved according to the content of nickel and that high-temperature creep characteristics are degraded as in the sample No. B4 if the content of nickel is excessive.

Accordingly, in order to ensure satisfactory high-temperature creep characteristics and normal-temperature toughness, it is necessary to adjust the content of nickel and those of molybdenum, tungsten, etc. in a well-balanced manner. TABLE-1 contains calculation values of Mo+W/2−Ni (hereinafter, Di-value) for the respective contents (wt %) of molybdenum, tungsten and nickel. Toughness is reduced in the materials having a Di-value above 0.7 (No. B2, No. B3), whereas high-temperature creep characteristics are reduced in the materials having a Di-value below −1.5 (No. B4) . Thus, by setting the composition so that the contents of molybdenum, tungsten and nickel satisfy a relationship: −1.5 wt %≦Di-value 0.7 wt %, there can be obtained a heat resisting steel having both satisfactory high creep characteristics and an excellent toughness.

On the other hand, as can be seen from TABLE-1, the sample No. A2 differs from the sample No. A1 mainly in the addition of cobalt; the sample No. A3 differs therefrom mainly in the addition of boron; and the sample No. A4 differs therefrom mainly in the addition of cobalt and boron. By further containing specified amounts of cobalt and boron, the high-temperature creep characteristics are further improved while an excellent normal-temperature toughness equal to or better than that of the sample No. A1 is maintained as shown in TABLE-2.

The samples Nos. A5, A6 differ from the sample A4 mainly in that the content of nickel is slightly reduced, and the samples Nos. A7, A6 differ therefrom mainly in that the contents of molybdenum and tungsten are slightly reduced as well as the content of nickel. These samples also satisfy the aforementioned relationship: −1.5 wt %≦Di-value≦0.7 wt %. In this case, although toughness (FATT) is somewhat reduced as the content of nickel is reduced, the characteristics equal to or better than the steel (No. B1) corresponding to M152 steel presently used as a disk material and the high-temperature creep characteristics are remarkably better than that of the sample No. B1.

As described above, according to the invention, there can be obtained a gas turbine disk material which has a satisfactory toughness and excellent high-temperature creep characteristics and, thus, can be suitably used at high temperatures by a composition comprised of 1.0 to 3.5 wt % of nickel, 0.50 to 0.90 wt % of molybdenum and 1.0 to 2.0 wt % of tungsten, the contents of nickel, molybdenum and tungsten satisfying a relationship −1.5 wt %≦Mo+W/2−Ni≦0.7 wt %.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A material for a gas turbine disk, comprising:

0.05 to 0.15 wt % of carbon, 0.10 wt % or less of silicon, 0.40 wt % or less of manganese, 9.0 to 12.0 wt % of chromium, 1.0 to 3.5 wt % of nickel, 0.50 to 0.90 wt % of molybdenum, 1.0 to 2.0 wt % of tungsten, 0.10 to 0.30 wt % of vanadium, 0.01 to 0.10 wt % of niobium, 0.01 to 0.05 wt % of nitrogen, and a remainder comprising iron and unavoidable impurities, wherein the contents of nickel, molybdenum and tungsten satisfy a relationship −1.5 wt %≦Mo+W/2−Ni≦0.7 wt %.

2. The material according to claim 1, further comprising either one of or both of 0.01 to 4.0 wt % of cobalt and 0.0001 to 0.010 wt % of boron.

3. The material according to claim 2, comprising 0.12–0.13 wt % of carbon, 0.05 wt % of silicon, 0.05–0.06 wt % of manganese, 10.33–10.70 wt % of chromium, 1.01–3.00 wt % of nickel, 0.67–0.71 wt % of molybdenum, 1.74–1.82 wt % of tungsten, 0.2 wt % of vanadium, 0.054–0.057 wt % of niobium, 0.025–0.027 wt % of nitrogen, optionally 0.11–3.73 wt % of cobalt, optionally 0.0002–0.0042 wt % of boron.

4. The material according to claim 3, wherein a 0.2% yield point for the material at 20° C. is between 102.3 to 108.1 $kg/mm^2$.

5. The material according to claim 3, wherein a tensile strength for the material at 20° C. is between 118.7 to 125.7 $kg/mm^2$.

6. The material according to claim 3, wherein an absorption energy for the material at 20° C. is between 16.5 to 26.7 kgfm.

7. The material according to claim 3, wherein a fracture appearance transition temperature for the material is between −70 to −20° C.

8. The material according to claim 3, wherein a creep rupture time at 500° C. and 50 $kg/mm^2$ is between 995 and 3361 hours.

9. The material according to claim 1, produced by a method comprising:

adjusting a steel composition using a deoxidation method to produce the material for a gas turbine disk;

melting said material;

producing an ingot from said material by a casting method;

hot forging said ingot;

quenching said forged ingot; thereby obtaining a uniform martensite texture;

tempering said forged ingot.

10. The material according to claim 9, wherein said deoxidation method is a vacuum carbon deoxidation method.

11. The material according to claim 9, wherein said quenching is oil quenching.

12. The material according to claim 9, wherein said tempering is double tempering.

13. The material according to claim 12, wherein said double tempering occurs at a temperature of 550 to 650° C.

14. The material according to claim 9, wherein said hot forging of said steel ingot occurs at a temperature of 900 to 1200° C.

* * * * *